US010942484B2

(12) United States Patent
Hiraoka

(10) Patent No.: US 10,942,484 B2
(45) Date of Patent: Mar. 9, 2021

(54) IMAGE FORMING APPARATUS HAVING EXPOSURE HEADS COUPLED TO TOP COVER

(71) Applicant: BROTHER KOGYO KABUSHIKI KAISHA, Nagoya (JP)

(72) Inventor: Junichi Hiraoka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/829,496

(22) Filed: Mar. 25, 2020

(65) Prior Publication Data

US 2020/0341425 A1 Oct. 29, 2020

(30) Foreign Application Priority Data

Apr. 25, 2019 (JP) ..... JP2019-084412

(51) Int. Cl.
*G03G 15/04* (2006.01)
*G03G 21/16* (2006.01)
*G03G 15/00* (2006.01)

(52) U.S. Cl.
CPC ... *G03G 21/1666* (2013.01); *G03G 15/04054* (2013.01); *G03G 21/1633* (2013.01); *G03G 15/5054* (2013.01); *G03G 15/757* (2013.01); *G03G 2221/1636* (2013.01)

(58) Field of Classification Search
CPC ..... G03G 15/011; G03G 15/04045; G03G 15/04054; G03G 21/1633; G03G 21/1666; G03G 2215/0409; G03G 2221/1636
USPC ..... 399/110, 118; 347/117, 118, 138
See application file for complete search history.

(56) References Cited

U.S. PATENT DOCUMENTS 8,364,059 B2 * 1/2013 Kato ..... G03G 21/1619 399/117
2009/0169261 A1 * 7/2009 Yokoi ..... G03G 15/04036 399/220
2009/0252528 A1 10/2009 Yamaguchi
2010/0020155 A1 * 1/2010 Tamaru ..... G03G 15/04054 347/238

(Continued)

FOREIGN PATENT DOCUMENTS

JP 2007-065125 A 3/2007
JP 2014-048334 A 3/2009

(Continued)

*Primary Examiner* — Robert B Beatty
(74) *Attorney, Agent, or Firm* — Merchant & Gould P.C.

(57) ABSTRACT

A first joint rotatably couples a link member with a first exposure head unit. A second joint rotatably couples the link member with a second exposure head unit. A first rotation center of the first exposure head unit is closer to an end of a top cover than a second rotation center of the second exposure head unit is. The link member is configured to, when the top cover moves from a closed position to an open position, cause the first exposure head unit to rotatably move in a direction in which a first optical member approaches the end of the top cover and cause the second exposure head unit to rotatably move in a direction in which a second optical member approaches the end. A distance between the first rotation center and the first joint is larger than a distance between the second rotation center and the second joint.

11 Claims, 8 Drawing Sheets

(56) References Cited

U.S. PATENT DOCUMENTS

| | | | | |
|---|---|---|---|---|
| 2010/0080616 | A1* | 4/2010 | Kamimura | G03G 15/04054 399/111 |
| 2012/0275819 | A1* | 11/2012 | Mori | G03G 21/1647 399/110 |
| 2013/0259517 | A1* | 10/2013 | Mori | G03G 21/1633 399/110 |
| 2013/0278705 | A1* | 10/2013 | Nakamura | B41J 2/325 347/238 |
| 2013/0315625 | A1 | 11/2013 | Fujita et al. | |
| 2014/0064781 | A1 | 3/2014 | Hashimoto et al. | |
| 2018/0095407 | A1* | 4/2018 | Tsukada | G03G 21/1628 |
| 2020/0209801 | A1* | 7/2020 | Nakajima | G03G 15/04036 |

FOREIGN PATENT DOCUMENTS

| | | | |
|---|---|---|---|
| JP | 2009-251231 | A | 10/2009 |
| JP | 2011-000780 | A | 1/2011 |
| JP | 2012-058287 | A | 3/2012 |
| JP | 2014-002354 | A | 1/2014 |

* cited by examiner

1

IMAGE FORMING APPARATUS HAVING EXPOSURE HEADS COUPLED TO TOP COVER

CROSS REFERENCE TO RELATED APPLICATIONS

This application claims priority from Japanese Patent Application No. 2019-084412 filed Apr. 25, 2019. The entire content of the priority application is incorporated herein by reference.

TECHNICAL FIELD

This disclosure relates to an image forming apparatus.

BACKGROUND

A conventionally known image forming apparatus includes a housing having an opening, a top cover, and four exposure head units. The top cover has a first end and a second end, and the first end side of the top cover is coupled to the housing. The top cover is rotatable about a rotational axis between an open position at which the opening is opened and a closed position at which the opening is closed.

SUMMARY

According to one aspect, this specification discloses an image forming apparatus. The image forming apparatus includes a housing, a top cover, a first photosensitive drum, a second photosensitive drum, a first exposure head unit, a second exposure head unit, and a link member. The housing is formed with an opening. The top cover has a first end rotatably coupled to the housing and a second end opposite the first end. The top cover is configured to rotatably move about a rotational axis between an open position at which the opening is opened and a closed position at which the opening is closed. The first photosensitive drum is disposed in the housing. The second photosensitive drum is disposed in the housing. The first exposure head unit is rotatably coupled to the top cover. The first exposure head unit is rotatable about a first rotation center. The first exposure head unit includes: a first light emitting portion; a first optical member configured to, in a state where the top cover is located at the closed position, form an image on a surface of the first photosensitive drum from light emitted from the first light emitting portion; a first head frame configured to support the first light emitting portion and the first optical member; and a first head joint located at an opposite side from the first optical member with respect to the first rotation center. The second exposure head unit is rotatably coupled to the top cover. The second exposure head unit is rotatable about a second rotation center. The second exposure head unit includes: a second light emitting portion; a second optical member configured to, in a state where the top cover is located at the closed position, form an image on a surface of the second photosensitive drum from light emitted from the second light emitting portion; a second head frame configured to support the second light emitting portion and the second optical member; and a second head joint located at an opposite side from the second optical member with respect to the second rotation center. The link member is configured to move in conjunction with opening and closing of the top cover. The link member includes a link member body, a first link joint, and a second link joint. The first link joint is provided at the link member body and is rotatably coupled to the first head joint. The first head joint and the first link joint constitute a first joint. The first joint rotatably couples the link member with the first exposure head unit. The second link joint is provided at the link member body and is rotatably coupled to the second head joint. The second head joint and the second link joint constitute a second joint. The second joint rotatably couples the link member with the second exposure head unit. The first rotation center is closer to the first end of the top cover than the second rotation center is. The link member is configured to, when the top cover moves from the closed position to the open position, cause the first exposure head unit to rotatably move in a direction in which the first optical member approaches the first end of the top cover and cause the second exposure head unit to rotatably move in a direction in which the second optical member approaches the first end of the top cover. A distance between the first rotation center and the first joint is larger than a distance between the second rotation center and the second joint.

BRIEF DESCRIPTION OF THE DRAWINGS

Embodiments in accordance with this disclosure will be described in detail with reference to the following figures wherein.

DETAILED DESCRIPTION

Figure 1:
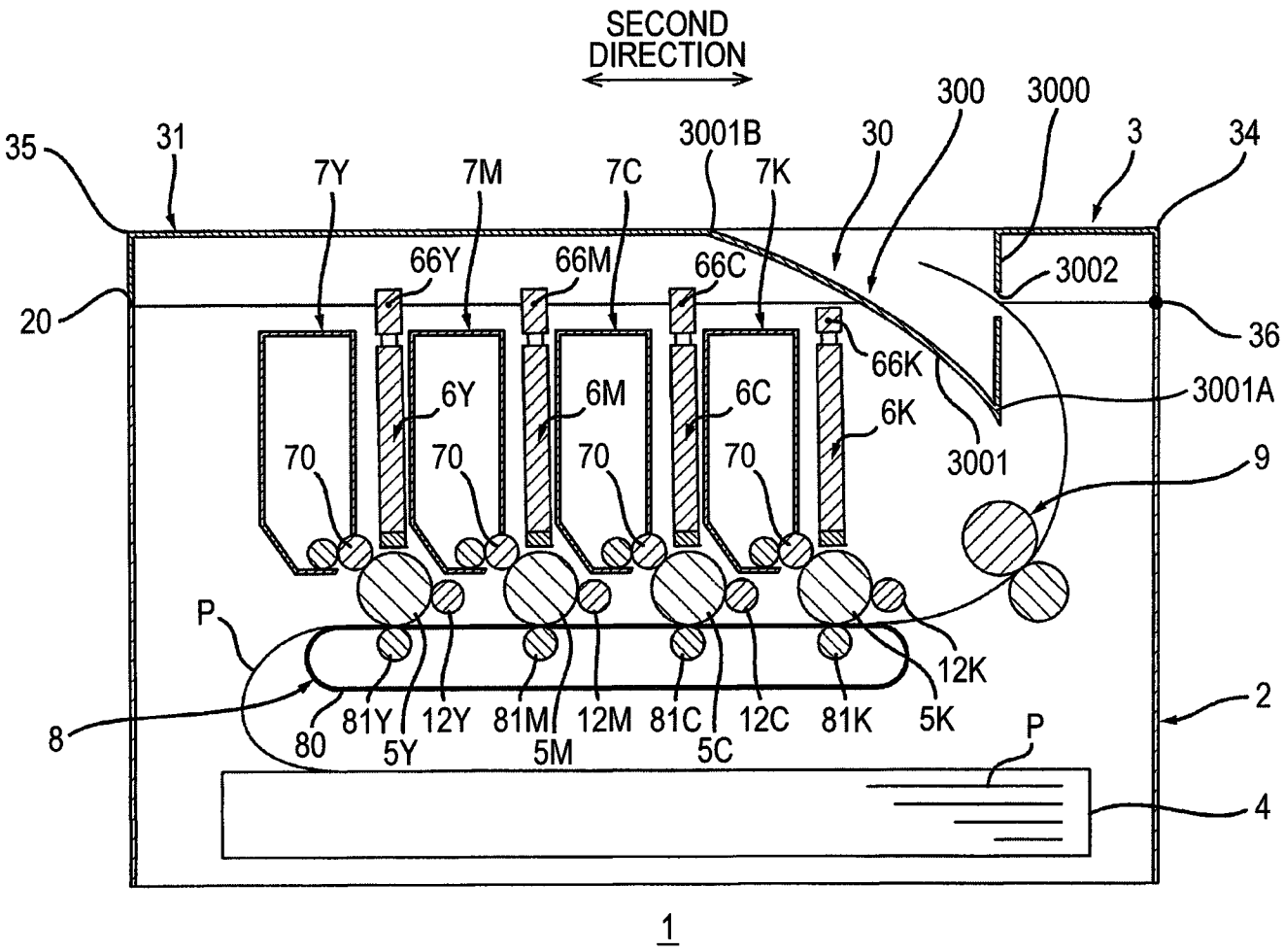
FIG. 1 is a diagram showing the schematic configuration of an image forming apparatus according to a first embodiment.

The top cover includes a paper discharge tray. In a state where the top cover is located at the closed position, the paper discharge tray is concaved toward inside the housing. The four exposure head units are rotatably coupled to the top cover. A link member moves in conjunction with the cover and causes the four exposure head units to rotatably move such that lower ends of the exposure head units come close to the first end of the top cover. Four joints couple the link member with the four exposure head units. The four exposure head units includes a first exposure head unit closest to the paper discharge tray and three second exposure head units other than the first exposure head unit. The four joints include a first joint coupling the link member with the first exposure head unit and second joints coupling the link member with the second exposure head units. The first joint has larger play than the second joints in the movement direction of the link member.

In this image forming apparatus, when the top cover moves from the closed position toward the open position, the link member moves in conjunction with the top cover, and firstly causes the second exposure head units coupled to the second joints having relatively small play to start rotation.

After that, since the play of the first joint is larger than the play of the second joints, the link member causes the first exposure head unit to start rotation behind the start of rotation of the second exposure head units.

Hence, in a state where the top cover is located at the open position, the folding amount of the first exposure head unit is smaller than the folding amount of the second exposure head units. As a result of that, in a state where the top cover is located at the open position, the first exposure head unit is located not to contact a wall constituting the paper discharge tray.

In this image forming apparatus, however, because the play of the first joint is larger than the play of the second joints in the movement direction of the link member, there is a possibility that, when opening or closing the top cover, the first exposure head unit swings by a larger amount than the second exposure head units. If the first exposure head unit swings when opening or closing the top cover, the space through which the first exposure head unit may pass becomes larger. Thus, it is necessary to secure, within the image forming apparatus, a larger space for preventing the first exposure head unit from hitting another part than a space for preventing the second exposure head units from hitting another part.

In view of the foregoing, an aspect of an object of this disclosure is to provide an image forming apparatus configured to reduce swinging of a first exposure head unit when opening or closing a top cover to the same degree as swinging of a second exposure head unit, while the folding amount of the first exposure head unit is smaller than the folding amount of the second exposure head units in a state where the top cover is located at the open position.

1. Overview of Image Forming Apparatus

An overview of an image forming apparatus 1 will be described while referring to FIG. 1.

As shown in FIG. 1, the image forming apparatus 1 is configured to form a toner image on a sheet-like recording medium (medium, recording material, or sheet). The sheet-like recording medium includes normal paper, thick paper, thin paper, an envelope, a postcard, a seal, a sheet for an overhead projector (OHP), plastic film, cloth, and so on. In the following description, paper is described as an example of a recording medium on which a toner image is formed by the image forming apparatus 1. Although the following description uses terms relating paper such as paper pass, paper feed, and paper discharge, the material of a recording medium is not limited to paper.

The image forming apparatus 1 includes a housing 2, a top cover 3, a paper feed tray 4, four photosensitive drums 5K, 5C, 5M, 5Y, four chargers 12K, 12C, 12M, 12Y, four exposure head units (four exposure head assemblies) 6K, 6C, 6M, 6Y, four development cartridges 7K, 7C, 7M, 7Y, a transfer device 8, and a fixing device 9.

1.1 Housing

The housing 2 accommodates the paper feed tray 4, the four photosensitive drums 5K, 5C, 5M, 5Y, the four chargers 12K, 12C, 12M, 12Y, the four exposure head units 6K, 6C, 6M, 6Y, the four development cartridges 7K, 7C, 7M, 7Y, the transfer device 8, and the fixing device 9. The housing 2 has an opening 20. The opening 20 is located at the opposite side from the transfer device 8 with respect to the four development cartridges 7K, 7C, 7M, 7Y. The opening 20 is located at the upper end of the housing 2.

1.2 Top Cover

The top cover 3 is configured to rotatably move about a rotational axis 36 between a closed position at which the opening 20 is closed and an open position (see FIG. 3) at which the opening 20 is opened. The rotational axis 36 extends in a first direction. The top cover 3 extends in a direction perpendicular to the first direction. The top cover 3 has a first end 34 and a second end 35. The first end 34 side of the top cover 3 is coupled to the housing 2. In the present embodiment, the first end 34 is directly rotatably coupled to the housing 2. The second end 35 is located away from the first end 34 in the direction perpendicular to the first direction. When the top cover 3 rotatably moves from the closed position to the open position, the second end 35 moves to separate from the housing 2 (see FIG. 3).

The top cover 3 includes a paper discharge tray 30. In a state where the top cover 3 is located at the closed position, the paper discharge tray 30 is located at the upper surface of the top cover 3. The paper discharge tray 30 has a concave portion 300. In a state where the top cover 3 is located at the closed position, the concave portion 300 is concaved toward inside the housing 2. The concave portion 300 has a first wall 3000 and a second wall 3001. In a state where the top cover 3 is located at the closed position, the first wall 3000 extends in a vertical direction. The first wall 3000 has a discharge opening 3002. The second wall 3001 is located at the opposite side from the first end 34 with respect to the first wall 3000. The second wall 3001 has a first end 3001A continuous with the first wall 3000 and a second end 3001B located away from the first end 3001A with respect to the direction in which the top cover 3 extends. In a state where the top cover 3 is located at the closed position, the first end 3001A of the second wall 3001 is continuous with the lower end of the first wall 3000, and the second end 3001B of the second wall 3001 is located at a higher position than the first end 3001A of the second wall 3001.

1.3 Paper Feed Tray

The paper feed tray 4 accommodates paper P. The paper P in the paper feed tray 4 is conveyed toward the photosensitive drum 5Y.

1.3' Photosensitive Drum

The four photosensitive drums 5K, 5C, 5M, 5Y are arranged in the housing 2. The four photosensitive drums 5K, 5C, 5M, 5Y are arranged in a second direction in this order from the side closer to the first end 34 of the top cover 3. The second direction intersects the first direction. The second direction is preferably perpendicular to the first direction. In a state where the top cover 3 is located at the closed position, the first end 34 and the second end 35 are preferably away from each other in the second direction. Each of the four photosensitive drums 5K, 5C, 5M, 5Y is rotatable about a rotational axis extending in the first direction. That is, the first direction is the direction of the rotational axis of the photosensitive drum 5K. Each of the four photosensitive drums 5K, 5C, 5M, 5Y extends in the first direction, and has a cylindrical shape.

1.4 Charger

The charger 12K charges the surface of the photosensitive drum 5K. The charger 12C charges the surface of the photosensitive drum 5C. The charger 12M charges the surface of the photosensitive drum 5M. The charger 12Y charges the surface of the photosensitive drum 5Y. Specially, each of the four chargers 12K, 12C, 12M, 12Y is a charging roller. Alternatively, each of the four chargers 12K, 12C, 12M, 12Y may be a scorotron-type charger.

1.5 Exposure Head Unit

The exposure head unit 6K is rotatably coupled to the top cover 3. The exposure head unit 6K is rotatable about a rotation center 66K. In a state where the top cover 3 is located at the closed position, the exposure head unit 6K is located between the development cartridge 7K and the first end 3001A of the second wall 3001 in the second direction. The exposure head unit 6K exposes the charged surface of the photosensitive drum 5K to form an electrostatic latent image on the surface of the photosensitive drum 5K.

The exposure head unit 6C is rotatably coupled to the top cover 3. The exposure head unit 6C is rotatable about a rotation center 66C. The exposure head unit 6C is located at the opposite side from the first end 34 of the top cover 3 with respect to the exposure head unit 6K. That is, the rotation center 66K of the exposure head unit 6K is located closer to the first end 34 of the top cover 3 than the rotation center 66C of the exposure head unit 6C is. In a state where the top cover 3 is located at the closed position, the exposure head unit 6C is located between the development cartridge 7K and the development cartridge 7C. The exposure head unit 6C exposes the charged surface of the photosensitive drum 5C to form an electrostatic latent image on the surface of the photosensitive drum 5C.

The exposure head unit 6M is rotatably coupled to the top cover 3. The exposure head unit 6M is rotatable about a rotation center 66M. The exposure head unit 6M is located at the opposite side from the exposure head unit 6K with respect to the exposure head unit 6C. In a state where the top cover 3 is located at the closed position, the exposure head unit 6M is located between the development cartridge 7C and the development cartridge 7M. The exposure head unit 6M exposes the charged surface of the photosensitive drum 5M to form an electrostatic latent image on the surface of the photosensitive drum 5M.

The exposure head unit 6Y is rotatably coupled to the top cover 3. The exposure head unit 6Y is rotatable about a rotation center 66Y. The exposure head unit 6Y is located at the opposite side from the exposure head unit 6C with respect to the exposure head unit 6M. In a state where the top cover 3 is located at the closed position, the exposure head unit 6Y is located between the development cartridge 7M and the development cartridge 7Y. The exposure head unit 6Y exposes the charged surface of the photosensitive drum 5Y to form an electrostatic latent image on the surface of the photosensitive drum 5Y.

1.6 Development Cartridge

Each of the four development cartridges 7K, 7C, 7M, and 7Y is configured to be mounted on the housing 2. The four development cartridges 7K, 7C, 7M, and 7Y have the same structure, and thus the development cartridge 7K will be described as an example.

The development cartridge 7K is configured to store toner. The development cartridge 7K includes a development roller 70. The development roller 70 is rotatable about an axis extending in the first direction. The development roller 70 extends in the first direction and has a cylindrical shape. In a state where the development cartridge 7K is mounted on the housing 2 of the image forming apparatus 1, the development roller 70 contacts the circumferential surface of the photosensitive drum 5K. The development roller 70 supplies toner to the circumferential surface of the photosensitive drum 5K, thereby developing the electrostatic latent image on the circumferential surface of the photosensitive drum 5K as a toner image. The development cartridge 7C supplies toner to the circumferential surface of the photosensitive drum 5C to form a toner image. The development cartridge 7M supplies toner to the circumferential surface of the photosensitive drum 5M to form a toner image. The development cartridge 7Y supplies toner to the circumferential surface of the photosensitive drum 5Y to form a toner image.

1.7 Transfer Device

The transfer device 8 includes a conveyance belt 80 and four transfer rollers 81K, 81C, 81M, 81Y. The conveyance belt 80 moves circuitously. The conveyance belt 80 conveys paper P toward the fixing device 9 such that the paper P supplied from the paper feed tray 4 contacts the photosensitive drums 5Y, 5M, 5C, 5K in this order.

The four transfer rollers 81K, 81C, 81M, 81Y are located inside the conveyance belt 80. The transfer roller 81K transfers the toner image formed on the surface of the photosensitive drum 5K onto paper P. The transfer roller 81C transfers the toner image formed on the surface of the photosensitive drum 5C onto paper P. The transfer roller 81M transfers the toner image formed on the surface of the photosensitive drum 5M onto paper P. The transfer roller 81Y transfers the toner image formed on the surface of the photosensitive drum 5Y onto paper P.

1.8 Fixing Device

The fixing device 9 applies heat and pressure to the paper P on which a toner image is transferred, thereby fixing the toner image on the paper P. The paper P having passed through the fixing device 9 passes through the discharge opening 3002, and is discharged to the paper discharge tray 30.

2. Details of Exposure Head Unit

Next, the details of the four exposure head units 6K, 6C, 6M, 6Y will be described while referring to FIG. 2. Among the four exposure head units 6K, 6C, 6M, 6Y, first, the exposure head unit 6K will be described.

Figure 2:
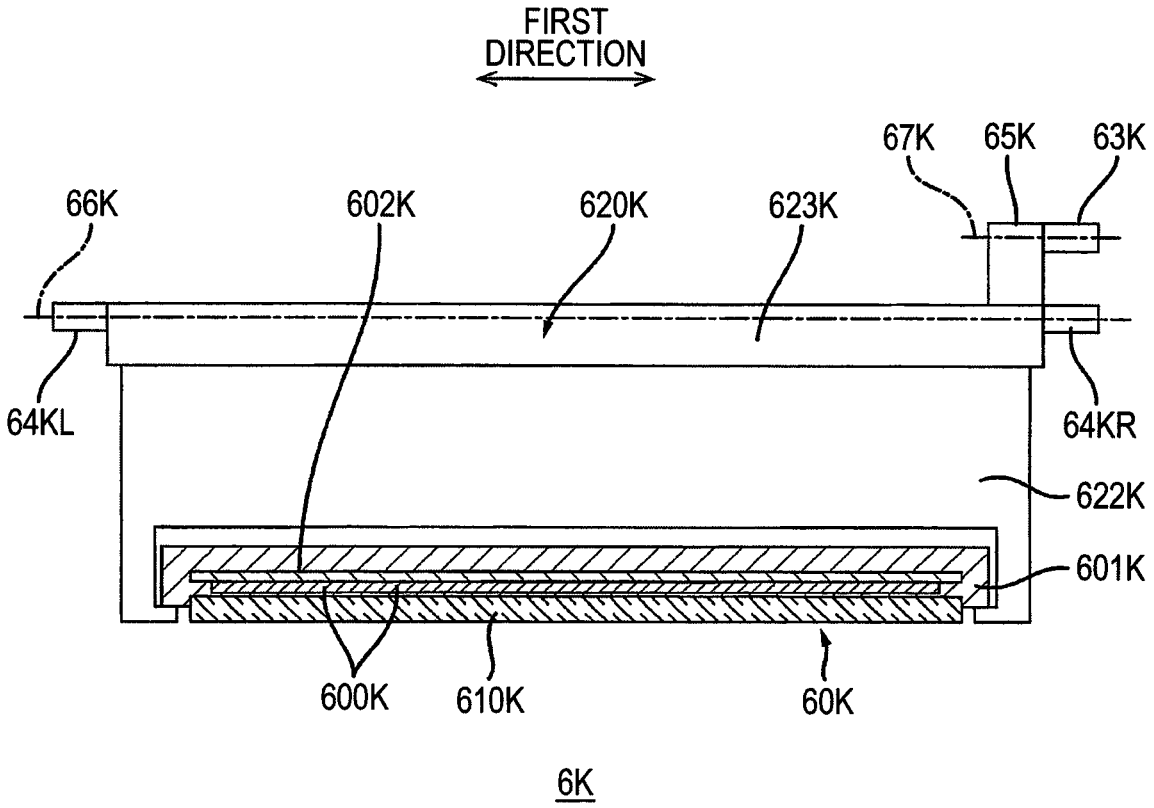
FIG. 2 is a diagram showing the schematic configuration of an exposure head unit shown in FIG. 1.

As shown in FIG. 2, the exposure head unit 6K includes a head holder 620K, a head frame 622K, and an LED print head (hereinafter referred to as "LPH") 60K.

2.1 Head Holder

The head holder 620K is coupled to the top cover 3. The head holder 620K includes a holder body 623K, two shafts 64KR, 64KL, an arm 65K, and a protrusion 63K.

The holder body 623K extends in the first direction. The holder body 623K supports the head frame 622K with small play such that the LPH 60K can be located at a correct position relative to the photosensitive drum 5K.

The two shafts 64KR, 64KL are provided at the holder body 623K. The two shafts 64KR, 64KL are located away from each other in the first direction. The shaft 64KR is located at the opposite side from the shaft 64KL with respect to the holder body 623K in the first direction. The shaft 64KR protrudes from the holder body 623K. The shaft 64KR extends in the first direction and has a cylindrical shape. A center axis 66K of the shaft 64KR extends in the first direction. The shaft 64KL has the same structure as the shaft 64KR, and can be described in the same manner.

The arm 65K is provided at the holder body 623K. The arm 65K is located at the opposite side from the head frame 622K with respect to the holder body 623K. The arm 65K protrudes from the head holder 620K toward the top cover 3.

The protrusion 63K is provided at the arm 65K. The protrusion 63K is located at the same side as the shaft 64KR with respect to the arm 65K in the first direction. The protrusion 63K protrudes from the arm 65K. The protrusion 63K extends in the first direction and has a cylindrical shape. A center axis 67K of the protrusion 63K extends in the first direction. The protrusion 63K is an example of a first head joint which constitutes part of a first joint.

2.2 Head Frame

The head frame 622K is coupled to the head holder 620K with small play. The head frame 622K supports the LPH 60K.

2.3 LPH

The LPH 60K includes an LPH frame 601K, a circuit board 602K, a light emitting portion 600K, an optical member 610K. That is, the exposure head unit 6K includes the LPH frame 601K, the circuit board 602K, the light emitting portion 600K, and the optical member 610K. Note that FIG. 2 shows a front cross-sectional view of the LPH 60K for illustrating the structure of the LPH 60K.

The LPH frame 601K supports the circuit board 602K, the light emitting portion 600K, and the optical member 610K. That is, the head frame 622K supports the circuit board 602K, the light emitting portion 600K, and the optical member 610K through the LPH frame 601K.

The circuit board 602K is located within the LPH frame 601K. The circuit board 602K is configured to supply power to the light emitting portion 600K. The circuit board 602K supports the light emitting portion 600K. The light emitting portion 600K is configured to emit light. The light emitting portion 600K includes a plurality of light emitting elements. The plurality of light emitting elements are arranged in the first direction. Specifically, the light emitting elements are LEDs. Alternatively, the light emitting elements may be organic EL elements.

In a state where the top cover 3 is located at the closed position, the optical member 610K forms an image from light emitted by the light emitting portion 600K on the surface of the photosensitive drum 5K. Specifically, the optical member 610K is a lens array constituted from a plurality of lenses. The optical member 610K is supported by the LPH frame 601K at the opposite side from the circuit board 602K with respect to the light emitting portion 600K. In a state where the top cover 3 is located at the closed position, the optical member 610K is located between the light emitting portion 600K and the photosensitive drum 5K.

2.4 Exposure Head Units 6C, 6M, 6Y

Each of the exposure head units 6C, 6M, 6Y has the same structure as the exposure head unit 6K, except the distance between the shaft 64 and the protrusion 63. Thus, the descriptions can be made in the same manner. That is, the exposure head unit 6C includes a head holder 620C, a head frame 622C, and an LPH 60C. The head holder 620C includes a holder body 623C, two shafts 64CR, 64CL, an arm 65C, and a protrusion 63C. The LPH 60C includes an LPH frame 601C, a circuit board 602C, a light emitting portion 600C, and an optical member 610C. In a state where the top cover 3 is located at the closed position, the optical member 610C forms an image from light emitted by the light emitting portion 600C on the surface of the photosensitive drum 5C. The head frame 622C supports the circuit board 602C, the light emitting portion 600C, and the optical member 610C through the LPH frame 601C. The protrusion 63C is an example of a second head joint which constitutes part of a second joint.

The exposure head unit 6M includes a head holder 620M, a head frame 622M, and an LPH 60M. The head holder 620M includes a holder body 623M, two shafts 64MR, 64ML, an arm 65M, and a protrusion 63M. The LPH 60M includes an LPH frame 601M, a circuit board 602M, a light emitting portion 600M, and an optical member 610M. In a state where the top cover 3 is located at the closed position, the optical member 610M forms an image from light emitted by the light emitting portion 600M on the surface of the photosensitive drum 5M. The head frame 622M supports the circuit board 602M, the light emitting portion 600M, and the optical member 610M through the LPH frame 601M. The protrusion 63M is an example of a third head joint which constitutes part of a third joint.

The exposure head unit 6Y includes a head holder 620Y, a head frame 622Y, and an LPH 60Y. The head holder 620Y includes a holder body 623Y, two shafts 64YR, 64YL, an arm 65Y, and a protrusion 63Y. The LPH 60Y includes an LPH frame 601Y, a circuit board 602Y, a light emitting portion 600Y, and an optical member 610Y. In a state where the top cover 3 is located at the closed position, the optical member 610Y forms an image from light emitted by the light emitting portion 600Y on the surface of the photosensitive drum 5Y. The head frame 622Y supports the circuit board 602Y, the light emitting portion 600Y, and the optical member 610Y through the LPH frame 601Y. The protrusion 63Y is an example of a fourth head joint which constitutes part of a fourth joint.

Here, the distance between the shaft 64CR and the protrusion 63C, the distance between the shaft 64MR and the protrusion 63M, and the distance between the shaft 64YR and the protrusion 63Y are equal to each other, and is smaller than the distance between the shaft 64KR and the protrusion 63K.

3. Details of Top Cover

Next, the details of the top cover 3 will be described while referring to FIGS. 3 and 4.

Figure 3:
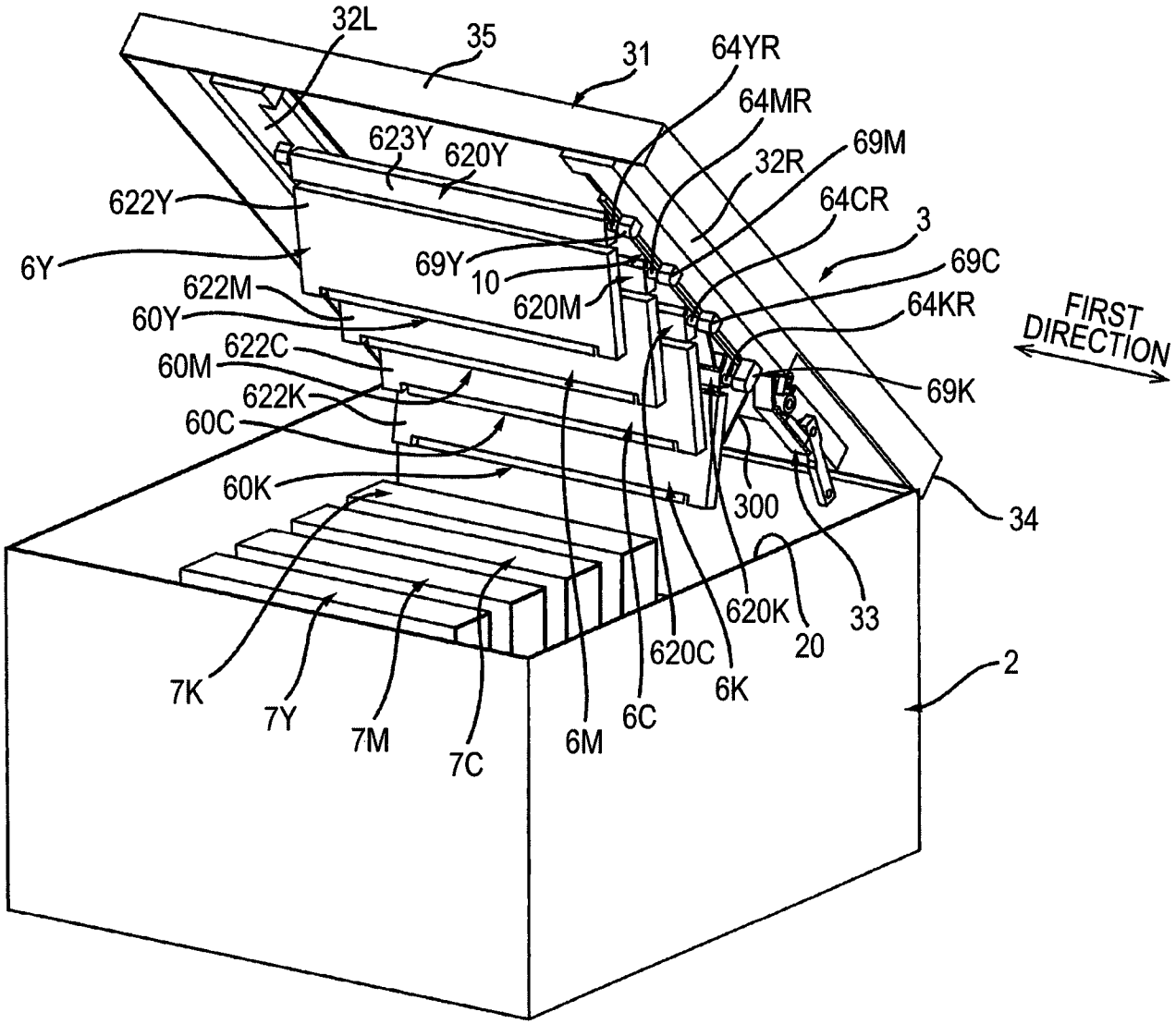
FIG. 3 is a perspective view of the image forming apparatus shown in FIG. 1 in a state where a top cover is located at an open position.

As shown in FIG. 3, the top cover 3 includes a cover body 31 including the paper discharge tray 30, two exposure head support sections 32R, 32L, and a link mechanism support section 33.

3.1 Cover Body

In a state where the top cover 3 is located at the closed position, the cover body 31 constitutes the upper surface of the image forming apparatus 1 (see FIG. 1).

3.2 Exposure Head Support Sections

The two exposure head support sections 32R, 32L rotatably support the four exposure head units 6K, 6C, 6M, 6Y. The two exposure head support sections 32R, 32L are supported by the cover body 31. The two exposure head support sections 32R, 32L are spaced away from each other in the first direction. The exposure head support section 32R is located at the opposite side from the exposure head support section 32L with respect to the four exposure head units 6K, 6C, 6M, 6Y in the first direction. The two exposure head support sections 32R, 32L have the same structure, and thus the exposure head support section 32R will be described as an example.

Figure 4:
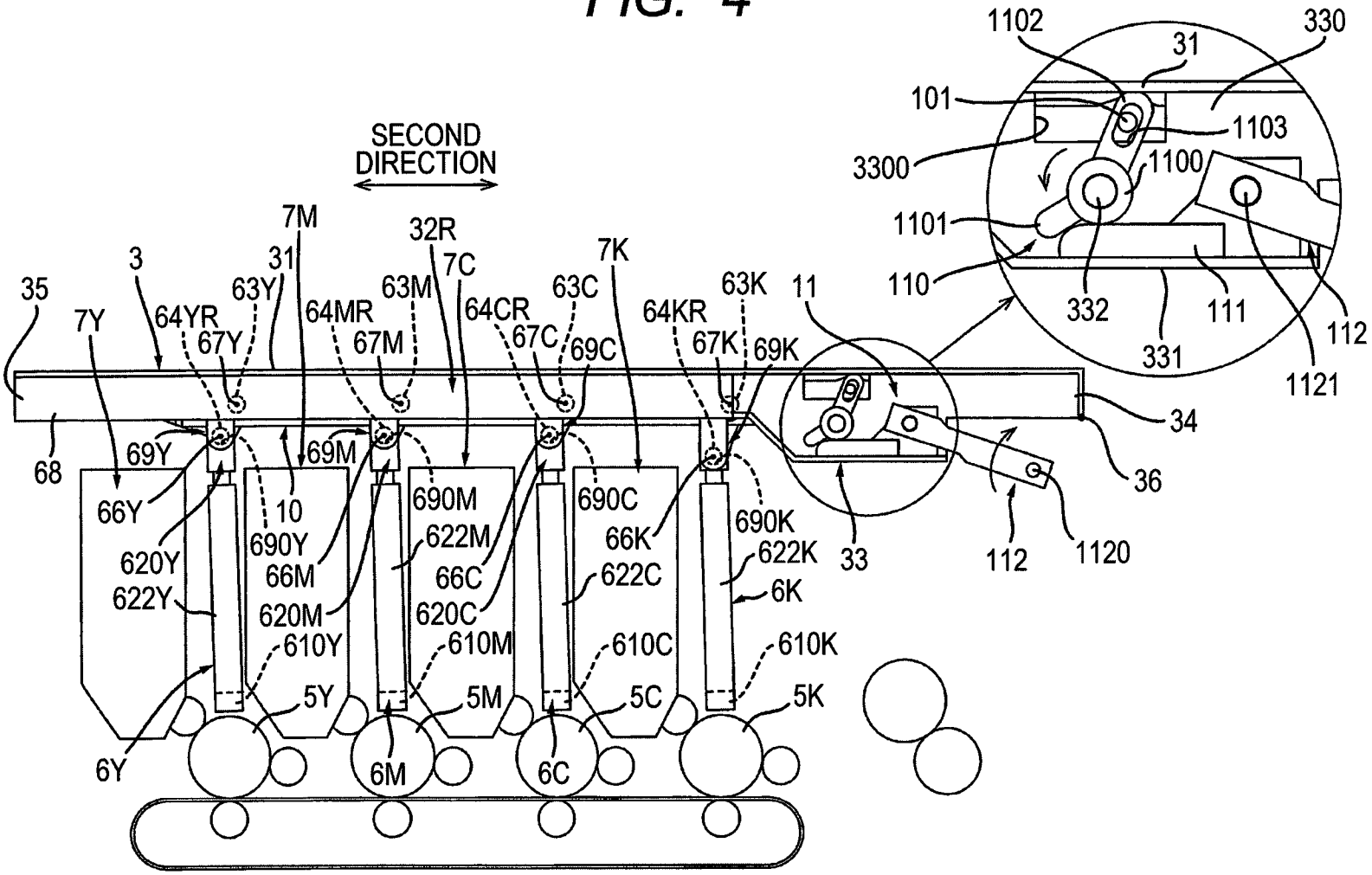
FIG. 4 is a side view of an exposure head support section and a link mechanism support section shown in FIG. 3.

As shown in FIG. 4, the exposure head support section 32R includes a support plate 68 and four bearings 69K, 69C, 69M, 69Y. In a state where the top cover 3 is located at the closed position, the support plate 68 protrudes downward from the cover body 31 and extends in the second direction. The support plate 68 faces the four arms 65K, 65C, 65M, 65Y with an interval therebetween in the first direction (see FIG. 5). In a state where the top cover 3 is located at the closed position, each of the four bearings 69K, 69C, 69M, 69Y protrudes downward from the lower end of the support plate 68. The four bearings 69K, 69C, 69M, 69Y are spaced from each other.

The bearing 69K rotatably supports the shaft 64KR. The bearing 69K has a hole 690K. The shaft 64KR is inserted in the hole 690K. The hole 690K has a circular shape. The inner diameter of the hole 690K is the same as the outer diameter of the shaft 64KR. The bearing 69K of the exposure head support section 32L rotatably supports the shaft 64KL. With this configuration, the exposure head unit 6K is rotatably supported by the top cover 3 while the center axis of the two shafts 64KR, 64KL serves as the rotation center 66K.

The bearing 69C rotatably supports the shaft 64CR. The bearing 69C has a hole 690C. The shaft 64CR is inserted in the hole 690C. The hole 690C has a circular shape. The inner diameter of the hole 690C is the same as the outer diameter of the shaft 64CR. The bearing 69C of the exposure head support section 32L rotatably supports the shaft 64CL. With this configuration, the exposure head unit 6C is rotatably supported by the top cover 3 while the center axis of the two shafts 64CR, 64CL serves as the rotation center 66C.

The bearing 69M rotatably supports the shaft 64MR. The bearing 69M has a hole 690M. The shaft 64MR is inserted in the hole 690M. The hole 690M has a circular shape. The inner diameter of the hole 690M is the same as the outer diameter of the shaft 64MR. The bearing 69M of the exposure head support section 32L rotatably supports the shaft 64ML. With this configuration, the exposure head unit 6M is rotatably supported by the top cover 3 while the center axis of the two shafts 64MR, 64ML serves as the rotation center 66M.

The bearing 69Y rotatably supports the shaft 64YR. The bearing 69Y has a hole 690Y. The shaft 64YR is inserted in the hole 690Y. The hole 690Y has a circular shape. The inner diameter of the hole 690Y is the same as the outer diameter of the shaft 64YR. The bearing 69Y of the exposure head support section 32L rotatably supports the shaft 64YL. With this configuration, the exposure head unit 6Y is rotatably supported by the top cover 3 while the center axis of the two shafts 64YR, 64YL serves as the rotation center 66Y.

3.3 Link Mechanism Support Section

The link mechanism support section 33 supports a link mechanism 11. The link mechanism 11 will be described later in detail. The link mechanism support section 33 is located between the exposure head support section 32R and the first end 34 of the top cover 3. The link mechanism support section 33 includes a first wall 330, a shaft 332, and a second wall 331.

In a state where the top cover 3 is located at the closed position, the first wall 330 extends downward from the cover body 31. The first wall 330 has a hole 3300. The shaft 332 rotatably supports a lever 110. The lever 110 will be described later. The shaft 332 is located at the opposite side from the cover body 31 with respect to the hole 3300. The shaft 332 extends from the first wall 330 in the first direction, and has a cylindrical shape. The second wall 331 guides movement of a first contact portion 111. The first contact portion 111 will be described later. The second wall 331 is located at the opposite side from the cover body 31 with respect to the shaft 332 with an interval from the cover body 31. The second wall 331 extends from the first wall 330 in the first direction.

4. Details of Image Forming Apparatus

Next, the details of the image forming apparatus 1 will be described while referring to FIGS. 4 and 5.

Figure 5:
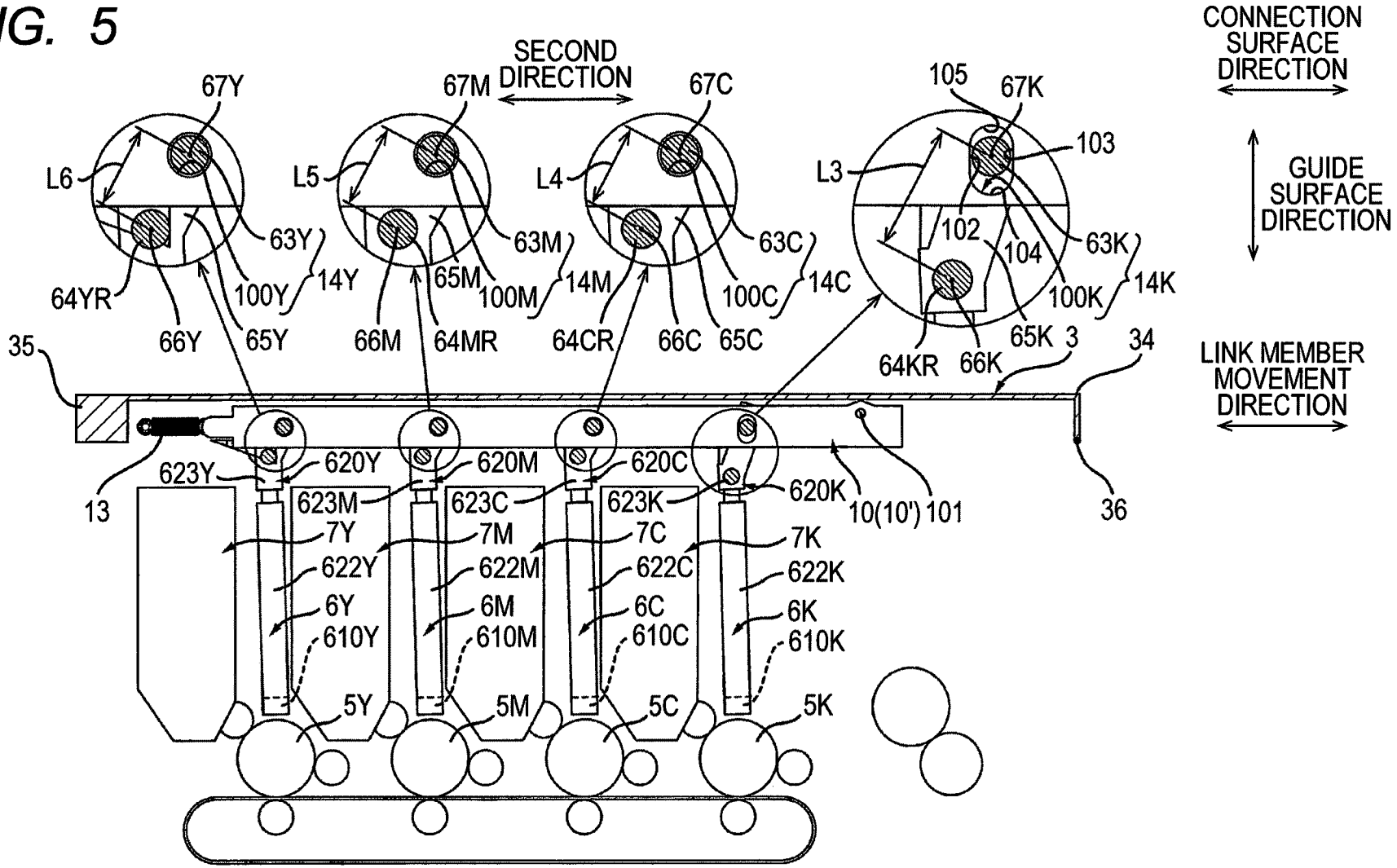
FIG. 5 is a side view for particularly showing a link member shown in FIG. 3.

As shown in FIGS. 4 and 5, the image forming apparatus 1 further includes a link member 10, four joints 14K, 14C, 14M, 14Y, a spring 13, and a link mechanism 11.

4.1 Link Member

The link member 10 is caused by the link mechanism 11 to move in conjunction with the opening and closing operation of the top cover 3. The link member 10 is located between the four arms 65K, 65C, 65M, 65Y and the support plate 68 in the first direction. The link member 10 is configured to move along the support plate 68. The movement direction of the link member 10 intersects the first direction.

As shown in FIG. 5, in a state where the top cover 3 is located at the closed position, the link member 10 extends in the second direction. The link member 10 includes a link member body 10', four holes 100K, 100C, 100M, 100Y and a boss 101. The link member body 10' extends in the movement direction of the link member 10. The four holes 100K, 100C, 100M, 100Y and the boss 101 are provided at the link member body 10'.

The four holes 100K, 100C, 100M, 100Y are spaced from each other with an interval and are arranged in this order from the side closer to the first end 34 with respect to the movement direction of the link member 10. The four holes 100K, 100C, 100M, 100Y will be described later in detail. The boss 101 extends in the first direction. The boss 101 is inserted through the hole 3300 of the first wall 330 (see FIG. 4). The hole 100K is an example of a first link joint which constitutes part of a first joint. The hole 100C is an example of a second link joint which constitutes part of a second joint. The hole 100M is an example of a third link joint which constitutes part of a third joint. The hole 100Y is an example of a fourth link joint which constitutes part of a fourth joint.

4.2 Joint

The four joints 14K, 14C, 14M, 14Y couple the link member 10 with the four exposure head units 6K, 6C, 6M, 6Y. The joint 14K couples the link member 10 with the exposure head unit 6K. The joint 14K is located at the opposite side from the optical member 610K with respect to the rotation center 66K of the exposure head unit 6K. The joint 14K is constituted by the protrusion 63K and the hole 100K. In other words, the joint 14K includes the protrusion 63K and the hole 100K. The protrusion 63K is inserted in the hole 100K. The protrusion 63K is located at the opposite side from the optical member 610K with respect to the rotation center 66K of the exposure head unit 6K. In a state where the top cover 3 is located at the closed position, the center axis 67K of the protrusion 63K is located at the first end 34 side of the top cover 3 with respect to the rotation center 66K. The hole 100K has two guide surfaces 102, 103 and two connection surfaces 104, 105.

The two guide surfaces 102, 103 guide movement of the protrusion 63K when the link member 10 moves. As shown in FIG. 5, the two guide surfaces 102, 103 extend in a direction (referred to as "guide surface direction") intersecting the movement direction of the link member 10. The two guide surfaces 102, 103 are parallel to each other. In a state where the top cover 3 is located at the closed position, the two guide surfaces 102, 103 extend in the vertical direction. The guide surface direction is preferably perpendicular to the first direction. Each of the two guide surfaces 102, 103 is a flat surface extending in the guide surface direction. Each of the two guide surfaces 102, 103 has a first end and a second end located at the opposite side from the first end in the guide surface direction. The two guide surfaces 102, 103 are spaced from each other with an interval in a direction (referred to as "connection surface direction") perpendicular to the guide surface direction. In a state where the top cover 3 is located at the closed position, the two guide surfaces 102, 103 are spaced from each other with an interval in the second direction. In other words, in a state where the top cover 3 is located at the closed position, the connection surface direction is parallel to the second direction. The connection surface direction is preferably perpendicular to the first direction. In the present embodiment, the connection surface direction is parallel to the movement direction of the link member 10.

The two connection surfaces 104, 105 are arranged with an interval in the guide surface direction. The connection surface 104 connects the first end of the guide surface 102 with the first end of the guide surface 103. The connection surface 105 connects the second end of the guide surface 102 with the second end of the guide surface 103. Each of the two connection surfaces 104, 105 is a curved surface having a semi-circular arc shape. Alternatively, each of the two connection surfaces 104, 105 may be a flat surface that extends linearly in the connection surface direction.

The size of the hole 100K in the guide surface direction intersecting the movement direction of the link member 10 is larger than the size of the protrusion 63K in the guide surface direction. The size of the hole 100K in the connection surface direction perpendicular to the guide surface direction is the same as the size of the protrusion 63K in the connection surface direction. In other words, the interval between the two guide surfaces 102, 103 in the connection surface direction is the same as the outer diameter of the protrusion 63K.

The joint 14C couples the link member 10 with the exposure head unit 6C. The joint 14C is located at the opposite side from the optical member 610C with respect to the rotation center 66C of the exposure head unit 6C. The joint 14C is constituted by the protrusion 63C and the hole 100C. In other words, the joint 14C includes the protrusion 63C and the hole 100C. The protrusion 63C is inserted in the hole 100C. In a state where the top cover 3 is located at the closed position, a center axis 67C of the protrusion 63C is located at the first end 34 side with respect to the rotation center 66C. The hole 100C has a circular shape. The inner diameter of the hole 100C is the same as the outer diameter of the protrusion 63C.

The joint 14M couples the link member 10 with the exposure head unit 6M. The joint 14M is located at the opposite side from the optical member 610M with respect to the rotation center 66M of the exposure head unit 6M. The joint 14M is constituted by the protrusion 63M and the hole 100M. In other words, the joint 14M includes the protrusion 63M and the hole 100M. The protrusion 63M is inserted in the hole 100M. In a state where the top cover 3 is located at the closed position, a center axis 67M of the protrusion 63M is located at the first end 34 side with respect to the rotation center 66M. The hole 100M has a circular shape. The inner diameter of the hole 100M is the same as the outer diameter of the protrusion 63M.

The joint 14Y couples the link member 10 with the exposure head unit 6Y. The joint 14Y is located at the opposite side from the optical member 610Y with respect to the rotation center 66Y of the exposure head unit 6Y. The joint 14Y is constituted by the protrusion 63Y and the hole 100Y. In other words, the joint 14Y includes the protrusion 63Y and the hole 100Y. The protrusion 63Y is inserted in the hole 100Y. In a state where the top cover 3 is located at the closed position, a center axis 67Y of the protrusion 63Y is located at the first end 34 side with respect to the rotation center 66Y. The hole 100Y has a circular shape. The inner diameter of the hole 100Y is the same as the outer diameter of the protrusion 63Y.

A distance L3 between the rotation center 66K of the exposure head unit 6K and the center axis 67K of the protrusion 63K of the joint 14K is larger than a distance L4 between the rotation center 66C of the exposure head unit 6C and the center axis 67C of the protrusion 63C of the joint 14C.

In the present embodiment, a distance L5 between the rotation center 66M of the exposure head unit 6M and the center axis 67M of the protrusion 63M of the joint 14M is the same as the distance L4. A distance L6 between the rotation center 66Y of the exposure head unit 6Y and the center axis 67Y of the protrusion 63Y of the joint 14Y is also the same as the distance L4.

4.3 Spring

The spring 13 urges the link member 10 toward the second end 35 side of the top cover 3. The spring 13 is located at the opposite side from the first end 34 of the top cover 3 with respect to the link member 10 in the movement direction of the link member 10. The spring 13 pulls the link member 10 toward the second end 35 side of the top cover 3. The spring 13 is an extension coil spring. The spring 13 has a first end and a second end in the movement direction of the link member 10. The first end of the spring 13 is fixed to the exposure head support section 32R. The second end of the spring 13 is fixed to the link member 10.

4.4 Link Mechanism

As shown in FIG. 4, the link mechanism 11 links the opening and closing operation of the top cover 3 with movement of the link member 10. The link mechanism 11 is supported by the link mechanism support section 33. The link mechanism 11 includes the lever 110, the first contact portion 111, and an arm 112.

The lever 110 includes a cylindrical portion 1100, a second contact portion 1101, and a coupling portion 1102. The cylindrical portion 1100 extends in the first direction and has a cylindrical shape. The shaft 332 of the link mechanism support section 33 is inserted in the cylindrical portion 1100. The second contact portion 1101 protrudes from the outer circumferential surface of the cylindrical portion 1100 in a radial direction of the cylindrical portion 1100. The coupling portion 1102 is located at the opposite side from the second contact portion 1101 with respect to the cylindrical portion 1100. The coupling portion 1102 protrudes from the outer circumferential surface of the cylindrical portion 1100 in a radial direction of the cylindrical portion 1100. The coupling portion 1102 has a boss hole 1103. The boss 101 of the link member 10 is inserted in the boss hole 1103 through the hole 3300.

The lever 110 is rotatable about the shaft 332. As described above, the link member 10 is urged by the spring 13 toward the second end 35 of the top cover 3 (see FIG. 5). Hence, the boss 101 presses the coupling portion 1102 toward the second end 35 of the top cover 3. Thus, the lever 110 receives force to rotatably move.

The first contact portion 111 restricts rotation of the lever 110. The first contact portion 111 contacts the second contact portion 1101 from the first end 34 side of the top cover 3. With this configuration, the first contact portion 111 restricts movement of the link member 10.

The arm 112 couples the housing 2 with the first contact portion 111. The arm 112 has a first end 1120 and a second end 1121. The first end 1120 of the arm 112 is rotatably supported by the housing 2. The first end 1120 of the arm 112 is located at a position spaced from the rotational axis 36 of the top cover 3 in the second direction. The first end 1120 of the arm 112 is located at a lower position than the rotational axis 36 of the top cover 3. The second end 1121 of the arm 112 is rotatably coupled to the first contact portion 111.

5. Operation of Exposure Head Unit When Top Cover Moves From Closed Position to Open Position Next, the operation of the exposure head unit 6 when the top cover 3 moves from the closed position to the open position will be described while referring to FIGS. 4 to 7.

When the top cover 3 moves from the closed position to the open position, the arm 112 rotatably moves such that the second end 1121 approaches the rotational axis 36 of the top cover 3 about the first end 1120. Thus, the first contact portion 111 moves to the first end 34 side along the second wall 331 so as to separate from the second contact portion 1101. Thus, due to this movement, the first contact portion 111 allows the lever 110 to rotatably move.

Figure 6:
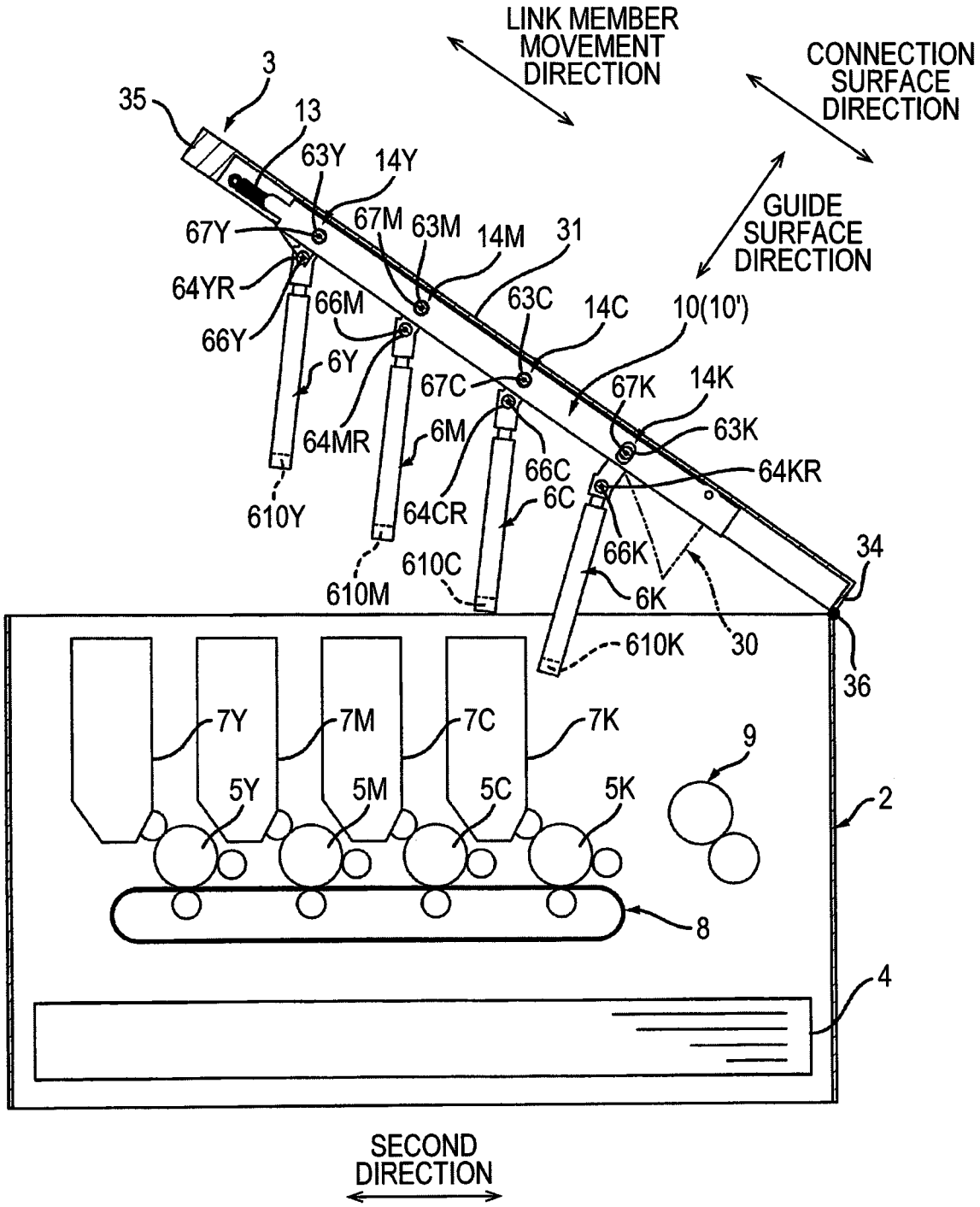
FIG. 6 is an explanatory diagram for illustrating a state where the top cover shown in FIG. 5 is located between a closed position and an open position.

Then, as shown in FIGS. 5 and 6, due to rotational movement of the lever 110, the link member 10 is caused by the spring 13 to move toward the second end 35 side of the top cover 3.

Here, the interval between the two guide surfaces 102, 103 is the same as the outer diameter of the protrusion 63K, the inner diameter of the hole 100C is the same as the outer diameter of the protrusion 63C, the inner diameter of the hole 100M is the same as the outer diameter of the protrusion 63M, and the inner diameter of the hole 100Y is the same as the outer diameter of the protrusion 63Y. That is, the four joints 14K, 14C, 14M, 14Y have the same degree of play in the movement direction of the link member 10. Specifically, in the present embodiment, the four joints 14K, 14C, 14M, 14Y have no play in the movement direction of the link member 10. Alternatively, the four joints 14K, 14C, 14M, 14Y may have the same degree of play larger than zero in the movement direction of the link member 10.

Hence, when the link member 10 moves toward the second end 35 side, the link member 10 presses the four protrusions 63K, 63C, 63M, 63Y concurrently. Thus, the protrusion 63K rotatably moves about the rotation center 66K, the protrusion 63C rotatably moves about the rotation center 66C, the protrusion 63M rotatably moves about the rotation center 66M, and the protrusion 63Y rotatably moves about the rotation center 66Y.

With this operation, the four exposure head units 6K, 6C, 6M, 6Y rotatably move and start folding concurrently. Specifically, the exposure head unit 6K rotatably moves in the direction in which the optical member 610K approaches the first end 34 of the top cover 3. The exposure head unit 6C separates from the space between the development cartridge 7K and the development cartridge 7C, and rotatably moves in the direction in which the optical member 610C approaches the first end 34. The exposure head unit 6M separates from the space between the development cartridge 7C and the development cartridge 7M, and rotatably moves in the direction in which the optical member 610M approaches the first end 34. The exposure head unit 6Y separates from the space between the development cartridge 7M and the development cartridge 7Y, and rotatably moves in the direction in which the optical member 610Y approaches the first end 34.

That is, when the top cover 3 moves from the closed position to the open position, the link member 10 causes the exposure head unit 6K to rotatably move in the direction in which the optical member 610K approaches the first end 34 of the top cover 3, and causes the exposure head unit 6C to rotatably move in the direction in which the optical member 610C approaches the first end 34 of the top cover 3. Further, when the top cover 3 moves from the closed position to the open position, the link member 10 causes the exposure head unit 6M to rotatably move in the direction in which the optical member 610M approaches the first end 34 of the top cover 3, and causes the exposure head unit 6Y to rotatably move in the direction in which the optical member 610Y approaches the first end 34 of the top cover 3.

Figure 7:
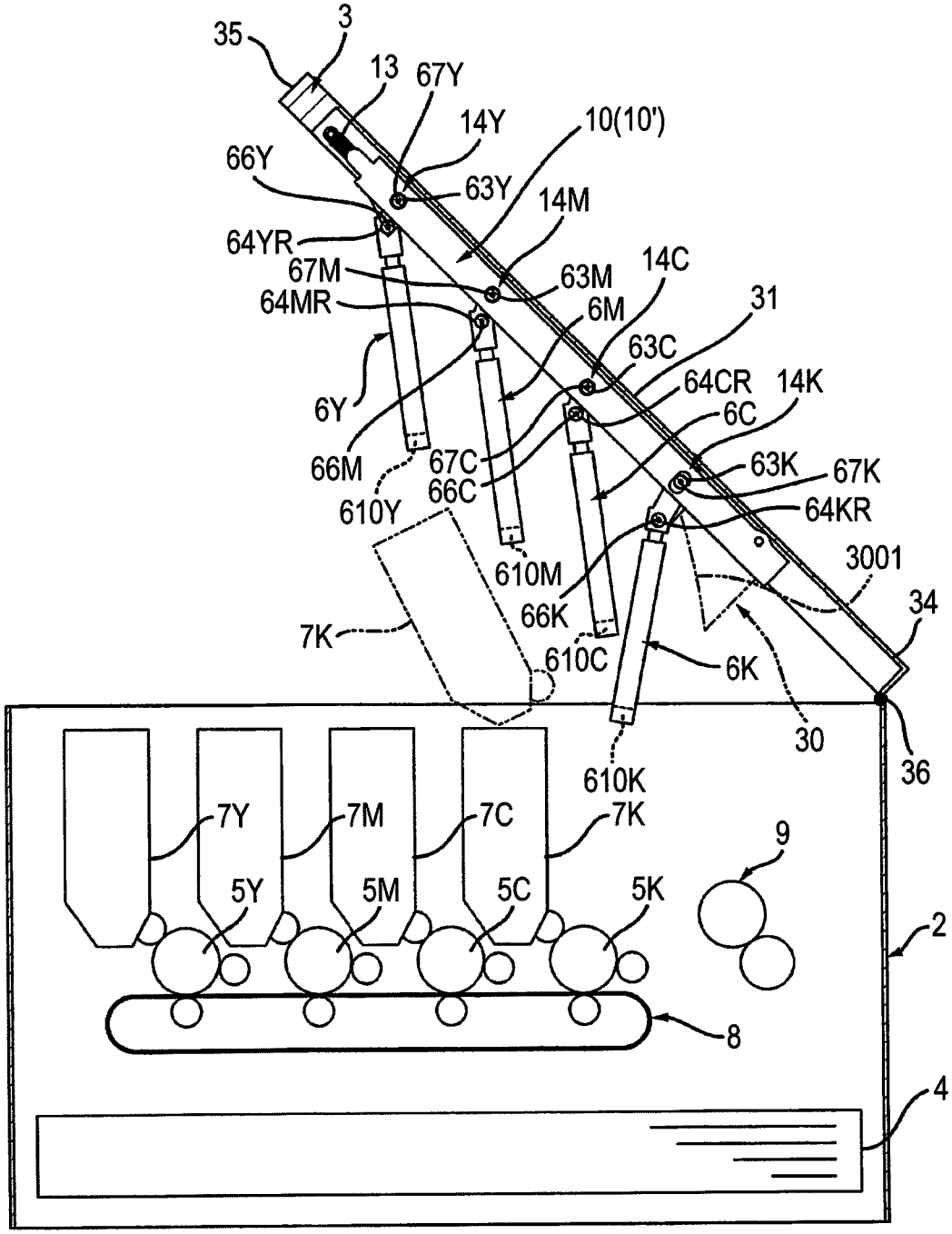
FIG. 7 is an explanatory diagram for illustrating the link member in a state where the top cover shown in FIG. 5 is located at the open position.

And, the link member 10 moves toward the second end 35 side and also moves to approach the cover body 31 due to the rotational movement of the three protrusions 63C, 63M, 63Y (see FIG. 6), and thereafter moves away from the cover body 31 (see FIG. 7). At this time, the two guide surfaces 102, 103 guide the movement of the protrusion 63K, and the hole 100K allows the movement of the protrusion 63K (see FIG. 5).

After that, as shown in FIG. 7, the top cover 3 reaches the open position. In a state where the top cover 3 is located at the open position, the center axis 67K of the protrusion 63K is located at the second end 35 side with respect to the rotation center 66K, and the optical member 610K of the exposure head unit 6K is located closer to the first end 34 than the joint 14K is. In a state where the top cover 3 is located at the open position, the center axis 67C of the protrusion 63C is located at the second end 35 side with respect to the rotation center 66C, and the optical member 610C of the exposure head unit 6C is located closer to the first end 34 than the joint 14C is. In a state where the top cover 3 is located at the open position, the center axis 67M of the protrusion 63M is located at the second end 35 side with respect to the rotation center 66M, and the optical member 610M of the exposure head unit 6M is located closer to the first end 34 than the joint 14M is. In a state where the top cover 3 is located at the open position, the center axis 67Y of the protrusion 63Y is located at the second end 35 side with respect to the rotation center 66Y, and the optical member 610Y of the exposure head unit 6Y is located closer to the first end 34 than the joint 14Y is.

Hence, in a state where the top cover 3 is located at the open position, the four exposure head units 6K, 6C, 6M, 6Y are folded to the top cover 3 side. As the development cartridge 7K is shown by the imaginary lines in FIG. 7, this suppresses the four exposure head units 6K, 6C, 6M, 6Y getting in the way of a mount operation of the development cartridges 7K, 7C, 7M, 7Y onto the housing 2.

Further, the distance L3 between the rotation center 66K of the exposure head unit 6K and the center axis 67K of the protrusion 63K is larger than the distance L4 between the rotation center 66C of the exposure head unit 6C and the center axis 67C of the protrusion 63C (see FIG. 5). Hence, in a state where the top cover 3 is located at the open position, the folding amount of the exposure head unit 6K relative to the top cover 3 (in other words, the rotation angle of the exposure head unit 6K relative to the top cover 3 when the top cover 3 moves from the closed position to the open position) is smaller than the folding amount of the exposure head unit 6C relative to the top cover 3. Hence, in a state where the top cover 3 is located at the open position, the exposure head unit 6K does not contact the paper discharge tray 30 and is located spaced from the second wall 3001 constituting the paper discharge tray 30.

6. Operations and Effects

As shown in FIGS. 5 and 6, in the joint 14K, the interval between the two guide surfaces 102, 103 is the same as the outer diameter of the protrusion 63K. In the joint 14C, the inner diameter of the hole 100C is the same as the outer diameter of the protrusion 63C. In the joint 14M, the inner diameter of the hole 100M is the same as the outer diameter of the protrusion 63M. In the joint 14Y, the inner diameter of the hole 100Y is the same as the outer diameter of the protrusion 63Y.

That is, the four joints 14K, 14C, 14M, 14Y have the same degree of play in the movement direction of the link member 10.

Hence, when the link member 10 moves in conjunction with the top cover 3, the four exposure head units 6K, 6C, 6M, 6Y rotatably move concurrently and start folding.

The distance L3 between the rotation center 66K of the exposure head unit 6K and the center axis 67K of the protrusion 63K is larger than the distance L4 between the rotation center 66C of the exposure head unit 6C and the center axis 67C of the protrusion 63C. The distance L5 between the rotation center 66M of the exposure head unit 6M and the center axis 67M of the protrusion 63M is the same as the distance L4. The distance L6 between the rotation center 66Y of the exposure head unit 6Y and the center axis 67Y of the protrusion 63Y is also the same as the distance L4.

Hence, when the four joints 14K, 14C, 14M, 14Y have the same degree of play and the four exposure head units 6K, 6C, 6M, 6Y rotatably move concurrently and start folding, in a state where the top cover 3 is located at the open position, the folding amount of the exposure head unit 6K is smaller than the folding amount of each of the three exposure head units 6C, 6M, 6Y.

Hence, as shown in FIG. 7, swinging of the exposure head unit 6K caused by the play of the joint 14K can be kept at the same level as swinging of the three exposure head units 6C, 6M, 6Y, and at the same time, in a state where the top cover 3 is located at the open position, the folding amount of the exposure head unit 6K is smaller than the folding amount of each of the three exposure head units 6C, 6M, 6Y. As a result of that, the second wall 3001 constituting the paper discharge tray 30 can be arranged near the exposure head unit 6K.

On the other hand, in a state where the top cover 3 is located at the open position, the folding amounts of the three exposure head units 6C, 6M, 6Y are made relatively large. This suppresses the three exposure head units 6C, 6M, 6Y getting in the way of the mount operation of the development cartridges 7K, 7C, 7M, 7Y.

Further, the swinging of the exposure head unit 6K caused by the play of the joint 14K is kept at the same level as the swinging of the three exposure head units 6C, 6M, 6Y. Thus, the space through which the exposure head unit 6K may pass when the top cover 3 is opened or closed can be reduced to the same level as the space through which each of the three exposure head units 6C, 6M, 6Y may pass.

As a result of that, the space cleared for preventing the exposure head unit 6K from hitting other parts can be reduced to the same level as the space cleared for preventing each of the three exposure head units 6C, 6M, 6Y from hitting other parts, which leads to downsizing of the image forming apparatus 1. Or, by utilizing the space cleared by reducing the space through which the exposure head unit 6K may pass, a large-volume development cartridge 7K for storing a larger amount of toner can be arranged, for example.

7. Second Embodiment

Next, a second embodiment of this disclosure will be described while referring to FIG. 8 wherein like parts and components are designated by the same reference numerals to avoid duplicating description.

Figure 8:
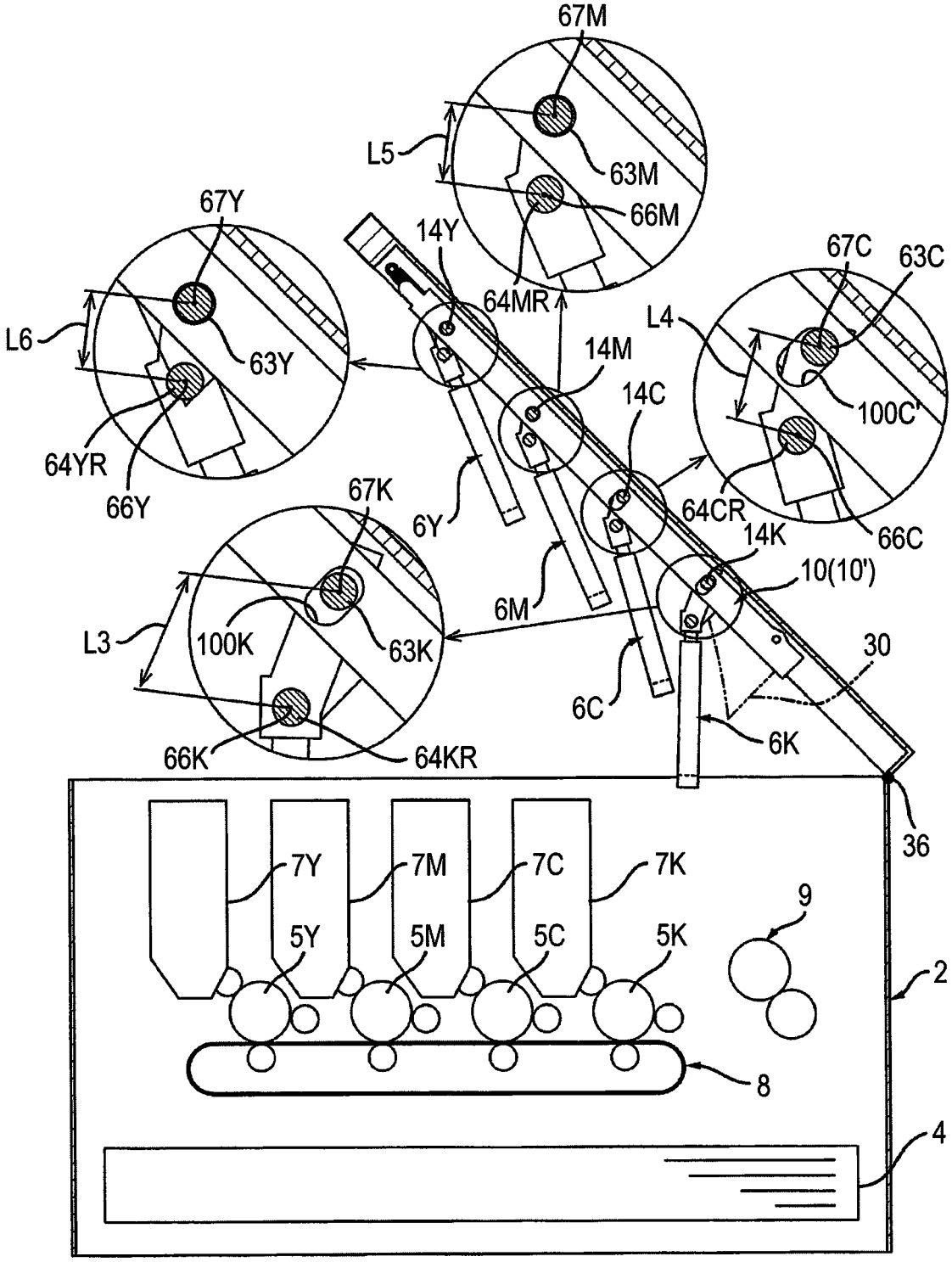
FIG. 8 is a diagram showing the schematic configuration of an image forming apparatus according to a second embodiment in a state where a top cover is located at an open position.

As shown in FIG. 8, in the image forming apparatus 1 of the second embodiment, the distance L5 between the rotation center 66M of the exposure head unit 6M and the center axis 67M of the protrusion 63M of the joint 14M is smaller than the distance L4 between the rotation center 66C of the exposure head unit 6C and the center axis 67C of the protrusion 63C of the joint 14C. The distance L6 between the rotation center 66Y of the exposure head unit 6Y and the center axis 67Y of the protrusion 63Y of the joint 14Y is also smaller than the distance L4. Further, the size of a hole 100C' in the guide surface direction (see FIG. 6) intersecting the movement direction of the link member 10 is larger than the size of the protrusion 63C in the guide surface direction.

Further, the distance L3 between the rotation center 66K of the exposure head unit 6K and the center axis 67K of the protrusion 63K of the joint 14K is larger than the distance L4 between the rotation center 66C of the exposure head unit 6C and the center axis 67C of the protrusion 63C of the joint 14C.

In the image forming apparatus 1, it is sometimes desired that the top cover 3 opens wider. However, if the top cover 3 is opened wider than the open position in the first embodiment (see FIG. 7), there is a possibility that the exposure head unit 6C contacts the exposure head unit 6K.

According to the second embodiment, the distance L4 between the rotation center 66C of the exposure head unit 6C and the center axis 67C of the protrusion 63C is smaller than the distance L3 between the rotation center 66K of the exposure head unit 6K and the center axis 67K of the protrusion 63K. The distance L4 is larger than the distance L5 between the rotation center 66M of the exposure head unit 6M and the center axis 67M of the protrusion 63M. The distance L4 is also larger than the distance L6 between the rotation center 66Y of the exposure head unit 6Y and the center axis 67Y of the protrusion 63Y.

Hence, in a state where the top cover 3 is located at the open position, the folding amount of the exposure head unit 6C is larger than the folding amount of the exposure head unit 6K but is smaller than each of the folding amount of the exposure head unit 6M and the folding amount of the exposure head unit 6Y. As a result of that, even when the top cover 3 is opened wider, the exposure head unit 6K is unlikely to contact a wall constituting the paper discharge tray 30 and the exposure head unit 6C is unlikely to contact the exposure head unit 6K. This configuration improves accessibility to the development cartridges 7K, 7C, 7M, 7Y mounted on the housing 2.

In the second embodiment, the operations and effects similar to those in the first embodiment are obtained.

8. Modification

While the disclosure has been described in detail with reference to the above aspects thereof, it would be apparent to those skilled in the art that various changes and modifications may be made therein without departing from the scope of the claims.

In the above-described first and second embodiments, the first end 34 of the top cover 3 is rotatably supported directly by the housing 2. However, the disclosure is not limited to this configuration. For example, the image forming apparatus 1 may include a hinge configured to rotatably couple the top cover 3 with the housing 2. In this case, the first end 34 side of the top cover 3 is coupled to the housing 2 through the hinge. Further, the image forming apparatus 1 may include a damper configured to couple the top cover 3 with the housing 2, the damper being for reducing the opening and closing speed of the top cover 3.

In the above-described first and second embodiments, the link member 10 is arranged at only one side of the four head holders 620K, 620C, 620M, 620Y in the first direction. Alternatively, the link member 10 may be arranged at both sides of the four head holders 620K, 620C, 620M, 620Y in the first direction.

In the above-described first and second embodiments, the exposure head units 6 include the protrusions 63, and the link member 10 includes the holes 100. Alternatively, the link member 10 may include protrusions 63, and the exposure head units 6 may include holes 100. With this configuration, the joints 14 may be formed.

In these modifications, the operations and effects similar to those in the first embodiment are obtained.

What is claimed is:

1. An image forming apparatus comprising:

a housing formed with an opening;

a top cover having a first end rotatably coupled to the housing and a second end opposite the first end, the top cover being configured to rotatably move about a rotational axis between an open position at which the opening is opened and a closed position at which the opening is closed;

a first photosensitive drum disposed in the housing;

a second photosensitive drum disposed in the housing;

a first exposure head unit rotatably coupled to the top cover, the first exposure head unit being rotatable about a first rotation center, the first exposure head unit including:

a first light emitting portion;

a first optical member configured to, in a state where the top cover is located at the closed position, form an image on a surface of the first photosensitive drum from light emitted from the first light emitting portion;

a first head frame configured to support the first light emitting portion and the first optical member; and a first head joint located at an opposite side from the first optical member with respect to the first rotation center;

a second exposure head unit rotatably coupled to the top cover, the second exposure head unit being rotatable about a second rotation center, the second exposure head unit including:

a second light emitting portion;

a second optical member configured to, in a state where the top cover is located at the closed position, form an image on a surface of the second photosensitive drum from light emitted from the second light emitting portion;

a second head frame configured to support the second light emitting portion and the second optical member; and a second head joint located at an opposite side from the second optical member with respect to the second rotation center; and a link member configured to move in conjunction with opening and closing of the top cover, the link member including:

a link member body;

a first link joint provided at the link member body and rotatably coupled to the first head joint, the first head joint and the first link joint constituting a first joint, the first joint rotatably coupling the link member with the first exposure head unit; and a second link joint provided at the link member body and rotatably coupled to the second head joint, the second head joint and the second link joint constituting a second joint, the second joint rotatably coupling the link member with the second exposure head unit, the first rotation center being closer to the first end of the top cover than the second rotation center is;

the link member being configured to, when the top cover moves from the closed position to the open position, cause the first exposure head unit to rotatably move in a direction in which the first optical member approaches the first end of the top cover and cause the second exposure head unit to rotatably move in a direction in which the second optical member approaches the first end of the top cover; and a distance between the first rotation center and the first joint being larger than a distance between the second rotation center and the second joint.

2. The image forming apparatus according to claim 1, wherein the first exposure head unit is configured such that, in a state where the top cover is located at the open position, the first optical member is closer to the first end of the top cover than the first joint is; and wherein the second exposure head unit is configured such that, in a state where the top cover is located at the open position, the second optical member is closer to the first end of the top cover than the second joint is.

3. The image forming apparatus according to claim 1, further comprising:

a third photosensitive drum disposed in the housing;

a fourth photosensitive drum disposed in the housing;

a third exposure head unit rotatably coupled to the top cover, the third exposure head unit being rotatable about a third rotation center, the third exposure head unit being located at an opposite side from the first exposure head unit with respect to the second exposure head unit, the third exposure head unit including:

a third light emitting portion;

a third optical member configured to, in a state where the top cover is located at the closed position, form an image on a surface of the third photosensitive drum from light emitted from the third light emitting portion;

a third head frame configured to support the third light emitting portion and the third optical member; and a third head joint located at an opposite side from the third optical member with respect to the third rotation center;

a fourth exposure head unit rotatably coupled to the top cover, the fourth exposure head unit being rotatable about a fourth rotation center, the fourth exposure head unit being located at an opposite side from the second exposure head unit with respect to the third exposure head unit, the fourth exposure head unit including:

a fourth light emitting portion;

a fourth optical member configured to, in a state where the top cover is located at the closed position, form an image on a surface of the fourth photosensitive drum from light emitted from the fourth light emitting portion;

a fourth head frame configured to support the fourth light emitting portion and the fourth optical member; and a fourth head joint located at an opposite side from the fourth optical member with respect to the fourth rotation center;

the link member further including:

a third link joint rotatably coupled to the third head joint, the third head joint and the third link joint constituting a third joint, the third joint rotatably coupling the link member with the third exposure head unit; and a fourth link joint rotatably coupled to the fourth head joint, the fourth head joint and the fourth link joint constituting a fourth joint, the fourth joint rotatably coupling the link member with the fourth exposure head unit, the link member being configured to, when the top cover moves from the closed position to the open position, cause the third exposure head unit to rotatably move in a direction in which the third optical member approaches the first end of the top cover and cause the fourth exposure head unit to rotatably move in a direction in which the fourth optical member approaches the first end of the top cover;

a distance between the third rotation center and the third joint being same as the distance between the second rotation center and the second joint; and a distance between the fourth rotation center and the fourth joint being same as the distance between the second rotation center and the second joint.

4. The image forming apparatus according to claim 1, further comprising:

a third photosensitive drum disposed in the housing;

a fourth photosensitive drum disposed in the housing;

a third exposure head unit rotatably coupled to the top cover, the third exposure head unit being rotatable about a third rotation center, the third exposure head unit being located at an opposite side from the first exposure head unit with respect to the second exposure head unit, the third exposure head unit including:

a third light emitting portion;

a third optical member configured to, in a state where the top cover is located at the closed position, form an image on a surface of the third photosensitive drum from light emitted from the third light emitting portion;

a third head frame configured to support the third light emitting portion and the third optical member; and a third head joint located at an opposite side from the third optical member with respect to the third rotation center;

a fourth exposure head unit rotatably coupled to the top cover, the fourth exposure head unit being rotatable about a fourth rotation center, the fourth exposure head unit being located at an opposite side from the second exposure head unit with respect to the third exposure head unit, the fourth exposure head unit including:

a fourth light emitting portion;

a fourth optical member configured to, in a state where the top cover is located at the closed position, form an image on a surface of the fourth photosensitive drum from light emitted from the fourth light emitting portion;

a fourth head frame configured to support the fourth light emitting portion and the fourth optical member; and a fourth head joint located at an opposite side from the fourth optical member with respect to the fourth rotation center;

the link member further including:

a third link joint rotatably coupled to the third head joint, the third head joint and the third link joint constituting a third joint, the third joint rotatably coupling the link member with the third exposure head unit; and a fourth link joint rotatably coupled to the fourth head joint, the fourth head joint and the fourth link joint constituting a fourth joint, the fourth joint rotatably coupling the link member with the fourth exposure head unit, the link member being configured to, when the top cover moves from the closed position to the open position, cause the third exposure head unit to rotatably move in a direction in which the third optical member approaches the first end of the top cover and cause the fourth exposure head unit to rotatably move in a direction in which the fourth optical member approaches the first end of the top cover;

a distance between the third rotation center and the third joint being smaller than the distance between the second rotation center and the second joint; and a distance between the fourth rotation center and the fourth joint being smaller than the distance between the second rotation center and the second joint.

5. The image forming apparatus according to claim 1, wherein one of the first head joint and the first link joint is a protrusion located at an opposite side from the first optical member with respect to the first rotation center;

wherein an other one of the first head joint and the first link joint is a hole in which the protrusion is inserted;

wherein a size of the hole in a particular direction intersecting a movement direction of the link member is larger than a size of the protrusion in the particular direction; and wherein a size of the hole in an other direction perpendicular to the particular direction is same as a size of the protrusion in the other direction.

6. The image forming apparatus according to claim 1, wherein the first light emitting portion includes a plurality of light emitting elements arranged in a rotational axis direction of the first photosensitive drum; and wherein the first optical member includes a lens array formed by a plurality of lenses.

7. The image forming apparatus according to claim 6, wherein the plurality of light emitting elements of the first light emitting portion are LEDs.

8. The image forming apparatus according to claim 1, wherein the top cover includes a paper discharge tray having a concave portion that is concaved toward inside the housing in a state where the top cover is located at the closed position; and wherein, in a state where the top cover is located at the open position, a folding amount of the first exposure head unit relative to the top cover is smaller than a folding amount of the second exposure head unit relative to the top cover, and the first exposure head unit does not contact the paper discharge tray.

9. The image forming apparatus according to claim 1, wherein the first joint and the second joint have a same degree of play in a movement direction of the link member.

10. The image forming apparatus according to claim 9, wherein one of the first head joint and the first link joint is a first protrusion located at an opposite side from the first optical member with respect to the first rotation center;

wherein an other one of the first head joint and the first link joint is a first hole in which the first protrusion is inserted;

wherein one of the second head joint and the second link joint is a second protrusion located at an opposite side from the second optical member with respect to the second rotation center;

wherein an other one of the second head joint and the second link joint is a second hole in which the second protrusion is inserted;

wherein a size of the first hole in the movement direction of the link member is same as a size of the first protrusion in the movement direction of the link member; and wherein a size of the second hole in the movement direction of the link member is same as a size of the second protrusion in the movement direction of the link member.

11. The image forming apparatus according to claim 1, further comprising:

a first development cartridge configured to store toner to be supplied to the first photosensitive drum; and a second development cartridge configured to store toner to be supplied to the second photosensitive drum, wherein the top cover includes a paper discharge tray having a concave portion that is concaved toward inside the housing in a state where the top cover is located at the closed position; and wherein, in a state where the top cover is located at the closed position, the first exposure head unit is located between the concave portion and the first development cartridge in a movement direction of the link member, and the second exposure head unit is located between the first development cartridge and the second development cartridge in the movement direction of the link member.

* * * * *